US009598880B2

(12) United States Patent
Walls et al.

(10) Patent No.: US 9,598,880 B2
(45) Date of Patent: Mar. 21, 2017

(54) LOCK CYLINDER INCLUDING MODULAR PLUG

(71) Applicant: Schlage Lock Company LLC, Indianapolis, IN (US)

(72) Inventors: Brian Edward Walls, Colorado Springs, CO (US); Jason Curtis Clifford, Colorado Springs, CO (US); Scott Douglas Welsby, Colorado Springs, CO (US)

(73) Assignee: Schlage Lock Company LLC, Indianapolis, IN (US)

( * ) Notice: Subject to any disclaimer, the term of this patent is extended or adjusted under 35 U.S.C. 154(b) by 5 days.

(21) Appl. No.: 14/194,546

(22) Filed: Feb. 28, 2014

(65) Prior Publication Data

US 2015/0247344 A1 Sep. 3, 2015

(51) Int. Cl.

| | |
|---|---|
| ***E05B 27/04*** | (2006.01) |
| ***E05B 29/04*** | (2006.01) |
| ***E05B 27/00*** | (2006.01) |
| ***E05B 9/08*** | (2006.01) |
| *E05B 29/00* | (2006.01) |
| *E05B 63/00* | (2006.01) |

(52) U.S. Cl.

CPC ..... *E05B 27/0017* (2013.01); *E05B 9/086* (2013.01); *E05B 27/0082* (2013.01); *E05B 27/0007* (2013.01); *E05B 29/0066* (2013.01); *E05B 63/0056* (2013.01); *Y10T 29/49876* (2015.01); *Y10T 70/752* (2015.04); *Y10T 70/7599* (2015.04); *Y10T 70/7616* (2015.04); *Y10T 70/7684* (2015.04)

(58) Field of Classification Search

CPC ..... E05B 27/0017; E05B 27/0007; E05B 27/001; E05B 27/005; E05B 27/0082; E05B 27/0057; E05B 29/0066; Y10T 70/7616; Y10T 70/7621; Y10T 70/7599; Y10T 70/7684

USPC .... 70/372, 375, 385, 490, 492–496, DIG. 3, 70/DIG. 15

See application file for complete search history.

(56) References Cited

U.S. PATENT DOCUMENTS

| | | | | |
|---|---|---|---|---|
| 1,965,336 A | | 7/1934 | Fitzgerald | |
| 2,024,441 A | * | 12/1935 | Fitz Gerald | 70/495 |
| 2,426,104 A | * | 8/1947 | Johnstone | 70/421 |
| 2,629,247 A | | 2/1953 | Deutsch | |
| 2,660,876 A | * | 12/1953 | Spain | 70/495 |

(Continued)

OTHER PUBLICATIONS

International Search Report and Written Opinion; International Searching Authority/US; International PCT Application No. PCT/US15/18052; Jun. 8, 2015; 8 pages.

(Continued)

*Primary Examiner* — Lloyd Gall

(74) *Attorney, Agent, or Firm* — Taft Stettinius & Hollister LLP

(57) ABSTRACT

In an exemplary embodiment, a plug assembly includes a plug body, a sidebar, a cover plate, and a plurality of rack pins positioned in the plug assembly. A first portion of the sidebar is positioned in the plug and a second portion protrudes beyond the outer surface of the plug body. The rack pins are configured to selectably resist and permit radially inward motion of the sidebar. The cover plate is operable to selectably retain the rack pins within the plug body.

23 Claims, 7 Drawing Sheets

(56) References Cited

U.S. PATENT DOCUMENTS

| | | | | | |
|---|---|---|---|---|---|
| 2,808,717 | A | | 10/1957 | Jacobi | |
| 2,879,658 | A | * | 3/1959 | Johnstone | 70/495 |
| 2,949,762 | A | * | 8/1960 | Johnstone | 70/495 |
| 3,080,744 | A | | 3/1963 | Spain | |
| 3,410,123 | A | * | 11/1968 | Jacobi | 70/495 |
| 3,499,302 | A | | 3/1970 | Flora et al. | |
| 3,597,948 | A | * | 8/1971 | Johnstone | 70/495 |
| 3,709,006 | A | * | 1/1973 | Seidewand | 70/495 |
| 3,722,240 | A | | 3/1973 | Spain et al. | |
| 4,393,673 | A | | 7/1983 | Widen | |
| 4,478,061 | A | | 10/1984 | Preddey | |
| 4,484,462 | A | | 11/1984 | Berkowitz | |
| 4,485,648 | A | * | 12/1984 | Rabinow | 70/495 |
| 4,750,342 | A | * | 6/1988 | Nakai | 70/496 |
| 5,067,335 | A | | 11/1991 | Widen | |
| 5,375,444 | A | | 12/1994 | Smith | |
| 5,540,071 | A | * | 7/1996 | Reikher | 70/495 |
| 5,640,865 | A | | 6/1997 | Widen | |
| 5,826,451 | A | | 10/1998 | Cook | |
| 6,301,942 | B1 | | 10/2001 | Shvarts | |
| 6,427,506 | B1 | * | 8/2002 | Prunbauer | 70/495 |
| 6,477,876 | B1 | * | 11/2002 | Kim | 70/495 |
| 6,481,255 | B2 | | 11/2002 | Theriault et al. | |
| 7,308,811 | B2 | | 12/2007 | Armstrong et al. | |
| 7,370,502 | B2 | * | 5/2008 | Widen | 70/493 |
| 7,448,239 | B1 | | 11/2008 | Huang et al. | |
| 7,584,635 | B2 | * | 9/2009 | Gan et al. | 70/338 |
| 7,647,798 | B1 | | 1/2010 | Jones et al. | |
| 7,810,365 | B2 | | 10/2010 | Villani | |
| 7,900,491 | B2 | | 3/2011 | Chong | |
| 7,963,135 | B1 | | 6/2011 | Tobias et al. | |
| 8,117,876 | B2 | | 2/2012 | Mathachan | |
| 8,186,194 | B2 | | 5/2012 | Field et al. | |
| 8,621,902 | B2 | * | 1/2014 | Mathachan | 70/492 |
| 8,656,747 | B2 | | 2/2014 | Armstrong et al. | |
| 2005/0011242 | A1 | | 1/2005 | Armstrong et al. | |
| 2008/0163657 | A1 | | 7/2008 | Dickhans et al. | |
| 2011/0259065 | A1 | | 10/2011 | Rao et al. | |
| 2012/0240646 | A1 | | 9/2012 | Herrmann | |
| 2013/0086958 | A1 | | 4/2013 | Emory | |
| 2015/0211256 | A1 | * | 7/2015 | Field | E05B 19/0064 70/350 |

OTHER PUBLICATIONS

Australian Patent Examination Report No. 1; Australian Patent Office; Australian Patent Application No. 2015222853; Nov. 11, 2016; 3 pages.

* cited by examiner

LOCK CYLINDER INCLUDING MODULAR PLUG

TECHNICAL FIELD

The present invention generally relates to locks, and more particularly, but not exclusively, to interchangeable core locks.

BACKGROUND

Lock cylinders, particularly those of the interchangeable core (IC) variety, have complex part tolerances and pinning to allow the cylinder to function. Because of the common design, these pinning complexities can also lead to lower security, which may result in unintended keys being able to operate the cylinder. The complexities can also make the pinning process difficult and laborious. If the pinning is off, the entire assembly must be emptied, and the user must start over. Furthermore, many traditional interchangeable core assemblies suffer from a tendency to "explode" when the plug is removed from the shell. That is to say, the springs eject the internal components out of the assembly, losing the pinning placement, and running the risk of damaging, destroying, or losing components. There is a need for the unique and inventive apparatuses, systems, and methods disclosed herein.

SUMMARY

In certain embodiments, a plug assembly includes a plug body, a sidebar, a cover plate, and a plurality of rack pins positioned in the plug assembly. A first portion of the sidebar is positioned in the plug and a second portion protrudes beyond the outer surface of the plug body. The rack pins are configured to selectably resist and permit radially inward motion of the sidebar. The cover plate is operable to selectably retain the rack pins within the plug body.

DETAILED DESCRIPTION OF ILLUSTRATIVE EMBODIMENTS

Figure 1:
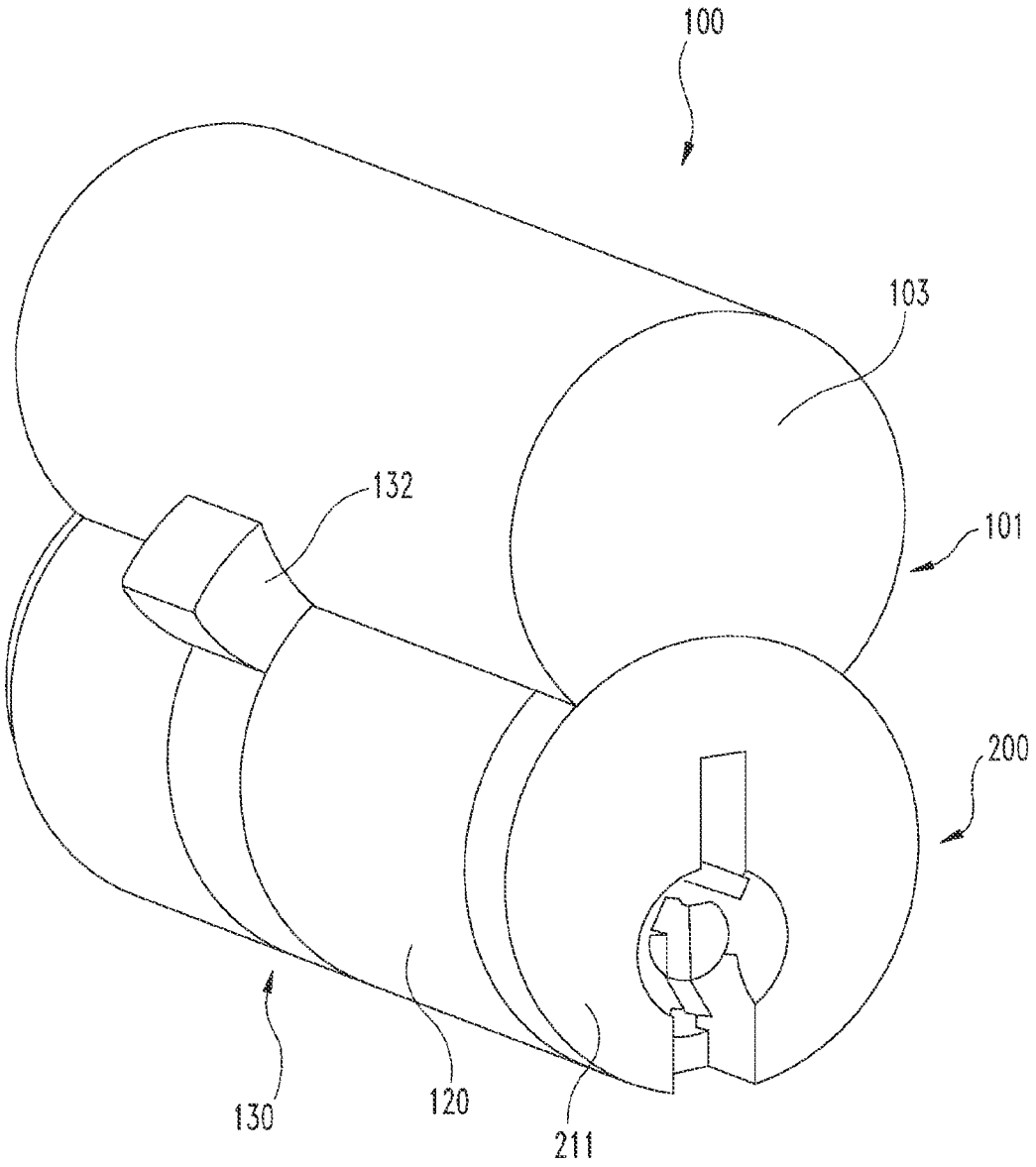
FIG. 1 is a perspective illustration of a lock cylinder according to an embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

As used hereinafter, a reference to the length, height, or width of an element of a locking cylinder is to be interpreted in light of the following characterization of the dimensions and definitions unless specifically noted otherwise. The geometry of the cylinder defines three mutually orthogonal axes; each dimension is measured along one of the axes. Length is measured along a first axis defined as the axial direction of the cylinder. Height is measured along a second axis, the direction in which the bittings are formed on a corresponding key, which will be referred to as the vertical direction. Width is measured along the third axis, which will be referred to as the horizontal direction. These terms are used for ease and convenience of description, and are without regard to the orientation of a system with respect to the environment. For example, descriptions that reference a vertical direction are equally applicable when the system is in a horizontal orientation or an off-axis orientation. Therefore the terms are not to be construed as limiting the scope of the subject matter herein.

With reference to FIG. 1, an illustrative cylinder 100 includes a shell 101 and a plug 200. The shell 101 includes a shell body 120. The shell 101 may further include a tower 103 configured to allow the cylinder 100 to be installed into an existing cylinder housing (not shown). In the illustrated embodiment, the tower 103 is configured such that the cylinder 100 can be installed into a small format interchangeable core (SFIC) housing. It is also contemplated that the shell 101 may be of another configuration, such as full size, mortise, rim, or key-in-knob/lever, or that the shell 101 may be towerless.

Figure 2:
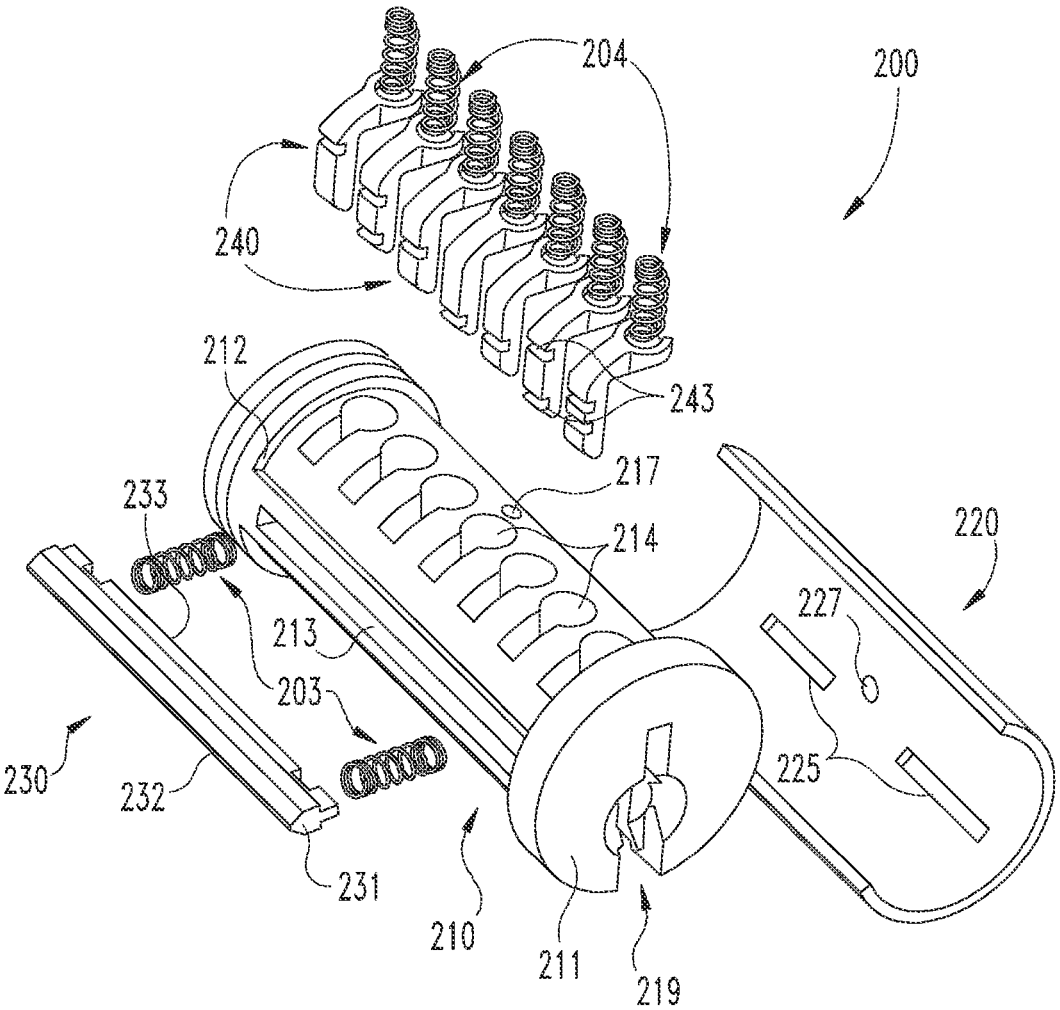
FIG. 2 is an exploded view of the lock plug used in the lock cylinder of FIG. 1.
Figure 3:
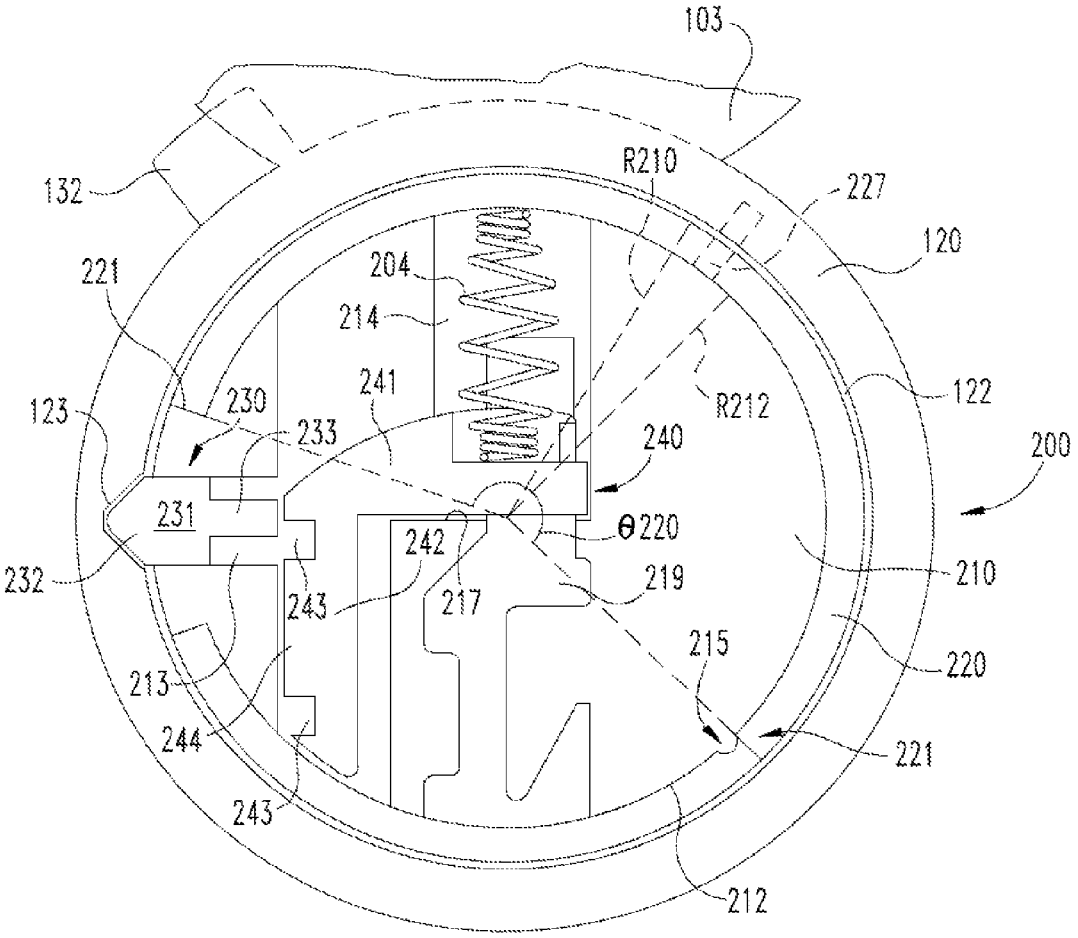
FIG. 3 is a cross-sectional view of the lock cylinder of FIG. 1 in a locked state.

With additional reference to FIGS. 2 and 3, the plug 200 is positioned partially within a generally cylindrical chamber 122 defined by the shell body 120. The plug 200 includes a plug body 210, a cover plate 220, a sidebar 230, and a plurality of rack pins 240. The shell body 120 also includes an axial groove 123 configured to receive a portion of the sidebar 230.

The plug body 210 includes a faceplate 211, a recessed portion 212, an axial channel 213, a plurality of cavities 214, and a keyway 219 configured to receive a key (not illustrated). The recessed portion 212 is an arcuate portion of the plug body 210 configured to receive the cover plate 220; the recessed portion 212 comprises a recess radius R212 which is less than the plug body radius R210. The channel 213 extends in the axial direction of the plug body 210, and is configured to the receive the sidebar 230 and biasing members 203. Each of the cavities 214 is configured to receive a rack pin 240 and a biasing member 204, and is connected to the recessed portion 212, the axial channel 213, and the keyway 219. Upon insertion of a key into the keyway 219, each rack pin 240 can engage both the sidebar 230 and the key.

The cover plate 220 is an arcuate plate including terminal surfaces 221 and slots 225. The inner radius of the cover plate 220 corresponds to the recess radius R212, and the outer radius corresponds to the plug body radius R210. The cover plate 220 is configured to be received in the recess 212 such that the cover plate 220 is rotatably coupled to the plug body 210. In the illustrated form, the cover plate 220 comprises an arc having a central angle θ220 greater than 180°, and the terminal surfaces 221 are separated by a distance less than the diameter across the recess 212. While the exemplary cover plate 220 comprises an arc having a central angle θ220 of about 200°, other central angles are also contemplated. In certain embodiments, a cover plate may have a central angle between 185° and 315°, between 190° and 280°, or between 195° and 220°. In other embodiments, the arc may have a central angle less than 180°; an exemplary form of one such cover plate is described below with reference to FIG. 5.

The illustrated cover plate 220 is slightly flexible, such that separating the terminal surfaces 221 by a distance corresponding to the diameter across the recess 212 does not cause permanent deformation of the cover plate 220. This allows the cover plate 220 to be installed into the recess 212 by pressing the cover plate 220 into the recess 212 in a snap-fit manner. When installed in the recess 212, the cover plate 220 is rotatably clamped to the plug body 210; in other words, the cover plate 220 can rotate about the longitudinal axis of the plug body 210 within the confines of the recess 212, but movement in the radial or axial direction of the plug body 210 is substantially prevented.

While the exemplary cover plate 220 is installed in the above-described snap-fit manner, it is also contemplated that the cover plate 220 may be installed by sliding the cover plate into the recess 212, for example, prior to affixing the faceplate 211. Alternatively, the recess 212 may extend to the end of the plug body 210 opposite the faceplate 211, and the cover plate 220 may be slid into the recess 212 and retained therein by a ridge or retainer (not illustrated).

The cover plate 220 is rotatable about the longitudinal axis of the plug body 210 between a closed position (FIG. 3) and an open position, and is capable of rotating between the closed position and the open position without being decoupled from the plug body 220. In the closed position, the cavities 214 are covered by the cover plate 220, and the rack pins 240 and the biasing members 204 are retained in the cavities 214. When the plug 200 is removed from the shell 101, the closed cover plate thus prevents the cylinder 100 from "exploding" without requiring the use of a plug follower. In the open position of the cover plate 220, the cavities 214 are exposed, and the rack pins 240 can be inserted into or removed from the cavities 214. This allows the plug 200 to be completely assembled prior to being installed in a shell appropriate for the lock type. The modular nature of the plug 200 enables installation of the same plug in any of a variety of shells corresponding to different lock types.

Rotation of the cover plate 220 from the open or closed position is resisted by a ridge 215 formed on the plug body 210. When the cover plate 220 is in the closed position, the ridge 215 contacts one of the terminal surfaces 221. When the cover plate 220 is in the open position, the ridge 215 is positioned in the slot 225. The distance by which the ridge 215 protrudes from the surface of the recessed portion 212 is great enough to resist incidental rotation of the cover plate 220, but small enough that intentional rotation is not prevented. In other words, the ridge 215 prevents rotation of the cover plate 220 in the absence of a threshold torque being applied. In certain embodiments, the ridge 215 may be a bump having a small length in the axial direction; in other forms, the ridge 215 may extend in the axial direction of the plug body 210. The cross-section of the ridge 215 may be curvilinear, rectilinear, or a combination thereof. In certain embodiments, the plug body 210 may include a plurality of ridges, or may not include a ridge. For example, one or more ridges may be formed on the cover plate 220, and correspondingly shaped grooves may be formed on the plug body 210.

The sidebar 230 is positioned in the axial channel 213, and is biased radially outward by the biasing members 203. The sidebar 230 includes a body portion 231, a tapered portion 232 on the radially outward side of body portion 231, and an interference member (illustrated as protrusion 233) on the radially inward side of the body portion 231. While the exemplary interference member is a single contiguous protrusion 233, the interference member may comprise a plurality of discrete protrusions in certain embodiments.

The height of the body portion 231 corresponds to the height of the channel 213, such that movement of the sidebar 230 is substantially confined to the radial direction of the plug body 210. In the illustrated form, the height of the protrusion 233 is less than the height of the body portion 231, although it is also contemplated that the body portion 231 and the protrusion 233 may be the same height or substantially the same height. Furthermore, while the tapered portion 232 is depicted as having a substantially rectilinear cross-section, it is also contemplated that the tapered portion 232 may comprise a curvilinear profile.

The rack pins 240 are positioned in the cavities 214 along with the biasing members 204, and each rack pin 240 includes a first leg 241 and a second leg 242. When the cover plate 220 is in the closed position, the biasing members 204 urge the rack pins 240 toward the keyway 219, such that each of the first legs 241 engages a ledge 217. In the illustrated embodiment, the first leg 241 is perpendicular to the second leg 242, although other configurations are contemplated. For example, in certain embodiments, the legs 241, 242 may be substantially perpendicular, or may be offset by an oblique angle. In the illustrated embodiment, the second leg 242 extends from the end of the first leg 241 in only a single direction, and the rack pin 240 can thus be considered an L-shaped rack pin.

The first leg 241 is positioned at least partially in the keyway 219, and is configured to travel along the top cut of a key. The first leg 241 may include a tapered bottom surface (for example, angled or curved) to facilitate such travel. When the key is inserted into the keyway 219, each of the rack pins 240 moves in a direction substantially perpendicular to the direction of key insertion as the first leg 241 travels along the top cut of the key. Due to the fact that the biasing members 204 urge the first legs 241 into contact with the key, the position of each of the rack pins 240 corresponds to the root depth of the key at the point of contact. If a rack pin 240 is blocked from moving in the necessary direction, the key cannot be inserted, due to the interference between the blocked rack pin 240 and the teeth of the key; this is equally true for extraction of the key.

The second leg 242 includes at least one notch 243 configured to receive a portion of the protrusion 233. One or more of the rack pins 240 may include more than one notch 243, such that the plug 200 can be master-keyed. When the notch 243 is aligned with the protrusion 233, protrusion 233 can enter the notch 243, and the rack pin 240 does not prevent the sidebar 230 from moving radially inward. When the notch 243 is misaligned with the protrusion 233, the protrusion 233 engages a contact surface 244 of the second leg 242, thereby preventing the sidebar 230 from moving radially inward.

The alignment or misalignment of the notch 243 and the protrusion 233 is determined by the vertical position of the rack pin 240, which in turn depends upon the root depth of an inserted key at the corresponding bitting position. When a proper key is inserted, each rack pin 240 has a notch 243 aligned with the protrusion 233. This defines an unlocked state of the plug 200, in which the sidebar 230 is free to move radially inward. When a proper key is not inserted, at least one of the rack pins 240 does not have a notch 243 aligned with the protrusion 233. This defines a locked state of the plug 200, in which the sidebar 230 is prevented from moving radially inward.

Figure 4:
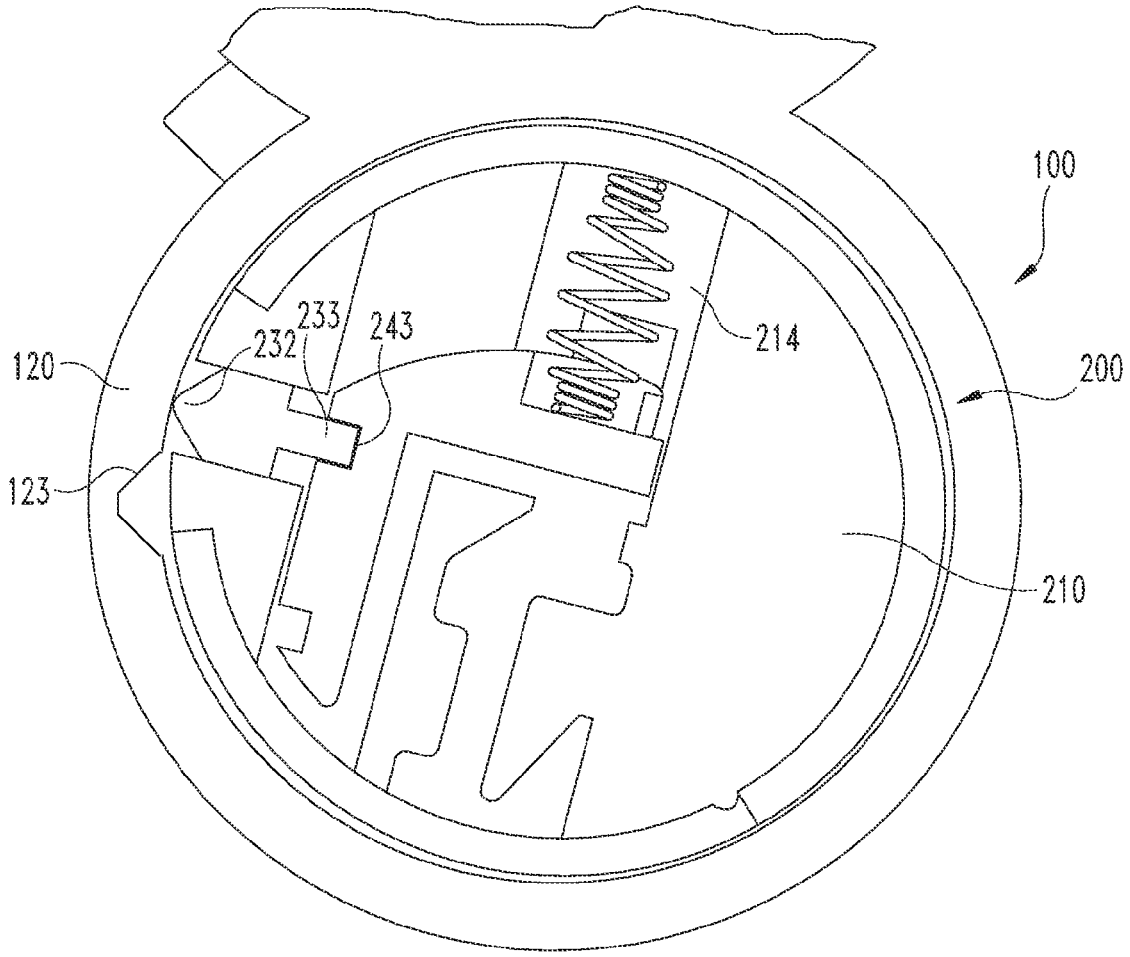
FIG. 4 is a cross-sectional view of the lock cylinder of FIG. 1 in an unlocked state.

With additional reference to FIG. 4, the operation of the cylinder 100 will now be described. FIG. 3 illustrates the plug 200 in a home position, wherein the biasing members 203 urge the sidebar to an extended position in which at least part of the tapered portion 232 is positioned in the groove 123. The plug 200 is also in the locked state, as the protrusion 233 is not aligned with the notch 243, and the interaction of the protrusion 233 and the contact surface 244 prevents the sidebar 230 from moving radially inward. In other words, the rack pin 240 retains the sidebar 230 in the extended position. Due to the fact that the sidebar 230 cannot move radially inward, the surfaces of the groove 123 interfere with the tapered portion 232, preventing rotation of the plug 200 with respect to the shell 101. The sidebar 230 is the only element that crosses the shear line of the cylinder 100, as the rack pins 240 are contained within the plug 200 by the cover plate 230.

As described above, when a proper key is inserted, each rack pin 240 has a notch 243 aligned with the protrusion 233, and the sidebar 230 is free to move radially inward. In this unlocked state, rotation of the plug 200 causes a surface of the groove 123 to interact with the tapered portion 232, thereby urging the sidebar 230 radially inward. That is to say, the surfaces of the groove 123 and the tapered portion 232 are cam surfaces configured to urge the sidebar 230 radially inward upon rotation of the plug 200. Once the plug 200 has been sufficiently rotated, the sidebar 230 is in a retracted position (FIG. 4), in which the protrusion 233 is received in the notch 243. In this rotated position of the plug 200, the tapered portion 232 is in contact with an inner surface of the shell 101, retaining the protrusion 232 within the notches 243. As noted above, in order for the key to be inserted into or extracted from the keyway 219, the rack pins 240 must be free to travel. In the rotated position of the plug 200, however, such travel is blocked, due to the protrusion 232 being retained within the notch 243. As such, when the plug 200 is in the rotated position, the key cannot be extracted.

As the plug 200 is rotated back to the home position, the biasing members 203 urge the sidebar 230 radially outward into the groove 123. The protrusion 233 is thus removed from the notch 243, and the rack pins 240 again become free to travel, permitting extraction of the key. Once the key is extracted, the biasing members 204 urge the rack pins 240 to their initial positions (FIG. 3), in which the protrusion 233 is misaligned with the recesses 243, and the plug 200 is in the locked state.

With continued reference to FIGS. 1-4, the exemplary cylinder 100 also includes a control member 130. The control member 130 is rotatable with respect to the shell 101, and includes a retaining lug 132 configured to engage a corresponding notch in the cylinder housing. In a first angular position of the control member 130 (FIG. 1), the retaining lug 132 radially protrudes from the shell 101 into the cylinder housing notch, preventing the cylinder 100 from being removed from the cylinder housing. When the control member 130 is rotated to a second angular position, the retaining lug 132 is positioned within the tower 103, and the cylinder 100 can be removed from the cylinder housing.

As best seen in FIG. 2, the plug body 210 may further include a control pin cavity 217, and the cover plate 220 may further include an opening 227. The control pin cavity 217 and the opening 227 are positioned such that, when the cover plate 220 is in the closed position, the opening 227 is aligned with the control pin cavity 217. When the plug 200 is in the home position (FIG. 3) and the cover plate 220 is in the closed position, the control pin cavity 217 and the opening 227 are aligned with a correspondingly-sized cavity formed in the control member 130. The control pin cavity 217 has disposed therein a control pin (not illustrated) operable in a first position in which a portion of the control pin extends into the control member cavity, and a second position in which the control pin does not extend into the control member cavity. The control pin is configured to interact with a feature of a change key, such that the control pin is in the first position when a proper change key is inserted in the keyway 219, and is in the second position when a proper change key is not so inserted.

When a proper change key is inserted, the plug 200 is in the unlocked state, and the control pin is in the first position. In this state, rotation of the plug 210 also causes rotation of the control member 130, due to the control pin extending into the control member cavity. Once the control member 130 is in the second angular position, the control lug 132 is positioned within the tower 103, and the cylinder 100 can be removed from the cylinder housing. In certain embodiments, the control pin may interact with sidemilling on the change key, such that the position of the control pin is independent of the key top cut, providing more security and control.

Once the cylinder 100 has been removed from the cylinder housing, the plug 200 can be removed from the shell 101 for re-pinning. In order to re-pin the plug 200, a user rotates the cover plate 220 from the closed position to the open position, where it may be retained by the ridge 215. The user removes at least some of the springs 204 and the rack pins 240 from the cavities 214. The user may simply rearrange some of the rack pins 240 (i.e. by placing at least some of the rack pins 240 in different cavities 214), may replace one or more of the rack pins 240 with new rack pins, or a combination thereof. The springs 204 are then put back into the cavities, and the cover plate 220 is rotated back to the closed position, where it is retained by the ridge 215. The user next inserts the plug 200 into the shell 101 (or another shell of the same, similar, or different format), inserts the cylinder 100 into the cylinder housing, and rotates the plug 200 and the control member 130 to a position in which the retaining lug 132 prevents removal of the cylinder 100 from the cylinder housing. Because the plug 200 is self-contained, there is no need to position springs and driving pins in the shell 101 during assembly, reducing the time and complexity of the pinning process.

Figure 5:
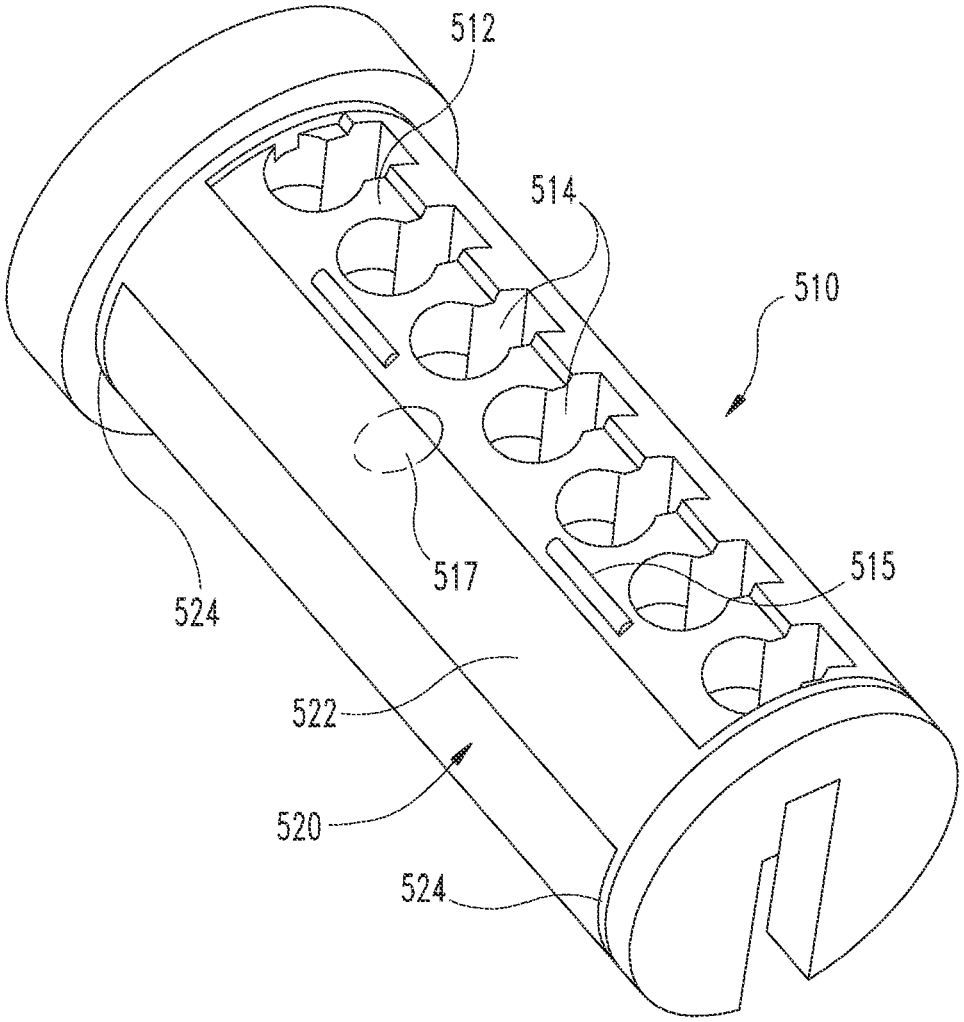
FIG. 5 is a perspective illustration of a plug body and cover plate according to an embodiment of the present invention.
Figure 5A:
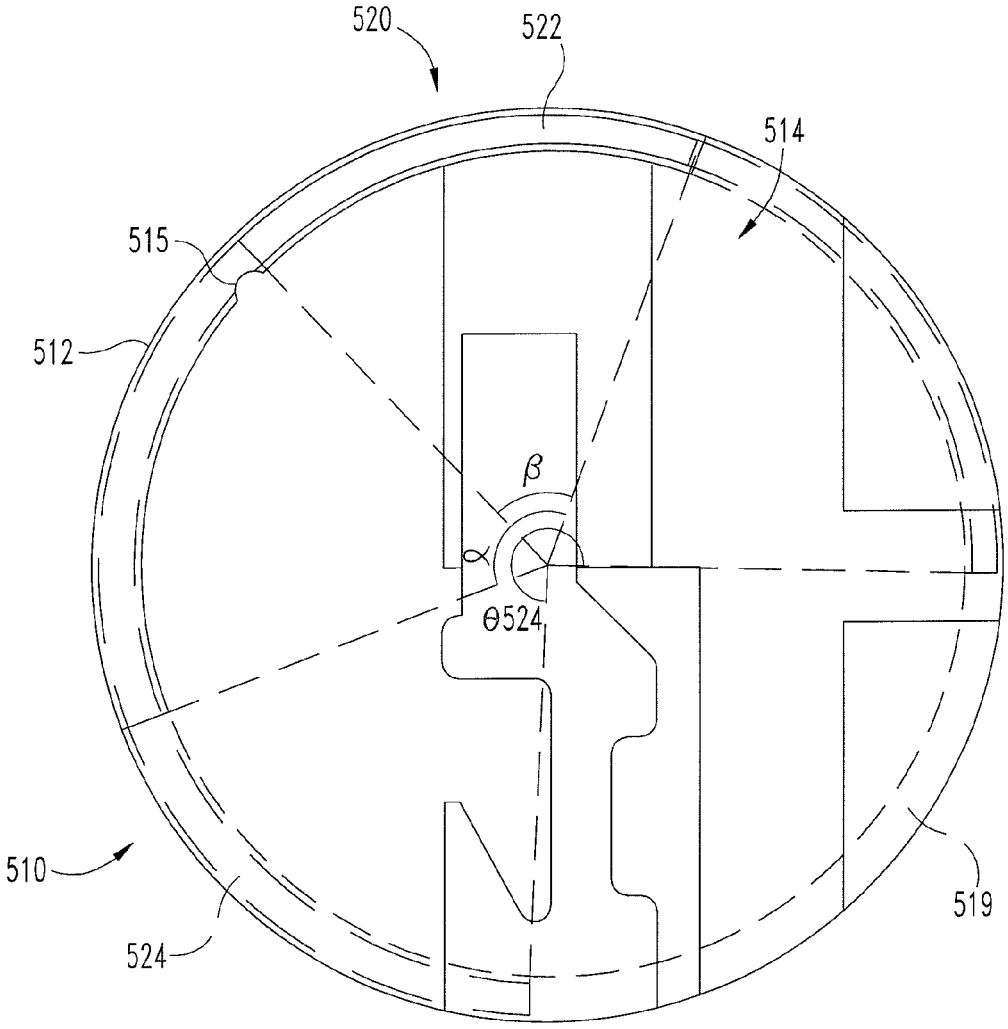
FIG. 5*a* is a cross-sectional illustration of the plug body and cover plate illustrated in FIG. 5.

FIGS. 5 and 5*a* illustrate a second exemplary plug body 510 and a cover 520. The plug body 510 is substantially similar to the plug body 210, and includes a recessed portion 512 having a radius less than that of the remainder of the plug body 510, and a plurality of cavities 514 configured to receive rack pins (not illustrated). The recessed portion 512 is an arcuate portion of the plug body 510; the central angle of the arc defined by the recessed portion is hereinafter referred to as the recess angle $\alpha$.

The cover 520 includes a cover plate 522 positioned in the recessed portion 512, and keepers 524 which rotatably couple the cover 520 to the plug body 510. The cover plate 522 is arcuate in geometry, and comprises a central angle which is hereinafter referred to as the cover plate angle $\beta$. The cover plate 522 comprises an inner radius corresponding to the radius of the recessed portion 512, and an outer radius corresponding to the outer radius of the plug body 510. The keepers 524 may be positioned in a circumferential groove 519 on the plug body 510. In the illustrated embodiment, the arcuate keepers 524 comprise a central angle θ524 of greater than about 190° and less than about 300°, and are snap-fit into the circumferential groove 519 in a manner similar to that described above with reference to the cover plate 220. In other embodiments, the keepers 524 may comprise a greater central angle, which may be up to 360°. In other words, the keepers 524 may be complete circles circumferentially surrounding a portion of the plug body 510. In still further embodiments, the keepers 524 may comprise a lesser central angle, and may be positioned in grooves on the faceplate and/or the end of the plug 510 opposite the faceplate.

The cover plate 522 is rotatable about the longitudinal axis of the plug body 510 along the recess 512. In an open position of the cover plate 522, the cavities 514 are exposed, and rack pins and biasing members (not illustrated) can be inserted or removed from the cavities 514. In a closed position of the cover plate 520, the cavities 514 are covered, and the pins and springs are retained within the cavities 514. In the illustrated embodiment, the plug body 510 includes two ridges 515 which extend along the axial direction of the plug body 510, and are configured to resist rotation of the cover plate 522 from the closed position. The ridges 515 are substantially similar to the ridge 215, and the descriptions of the illustrated and alternative features of the ridge 215 are equally applicable to the ridges 515.

In the illustrated embodiment, the recess angle α is slightly greater than twice the cover plate angle β, and the ridges 515 bisect the recessed portion 512 into first and second recessed sections, the angular span of each corresponding to the cover plate angle β. For example, if the cover plate angle θ is 30°, the recess angle α may be between about 62° and about 70°. As such, the cover plate 522 can be stably positioned in either the open position or the closed position, and the ridges 515 will retain the cover plate 522 in the selected position until the user rotates the cover plate 522 to the new position. In this manner, the ridges 515 facilitate the pinning process, and ensure that the cover plate 522 remains in the closed position when installed into a shell (such as the previously-described shell 101).

While the cover plate 522 comprises an are having a central angle of about 30°, other central angles are contemplated. In certain embodiments, the cover plate 522 may comprise an are having a central angle between 10° and 180°, between 15° and 90°, or between 20° and 45°. In certain embodiments, the recess angle α may be more than twice the cover plate angle β. In further embodiments, the recess angle α may be less than twice the cover plate angle β, in which case the cover plate 522 may include slots configured engage the ridges 515 when the cover plate 522 is in the open or closed position in a manner similar to that described with reference to the slots 225. Furthermore, in certain embodiments, the ridges 515 may not bisect the recessed portion 512.

A common form of picking locks includes applying torque to a lock plug, and adjusting the position of a pin until the resistive force provided by the pin changes. This change in resistive force is interpreted by the picker as an indication that the pin or tumbler is aligned with the shear line, and will no longer prevent rotation of the plug. The process is repeated until each of the pins is in the unlocking position, and the plug can be rotated. To combat such picking, certain embodiments of the invention may include anti-tampering features; an exemplary form of such anti-tampering features will now be described with reference to FIGS. 2 and 6.

Figure 6:
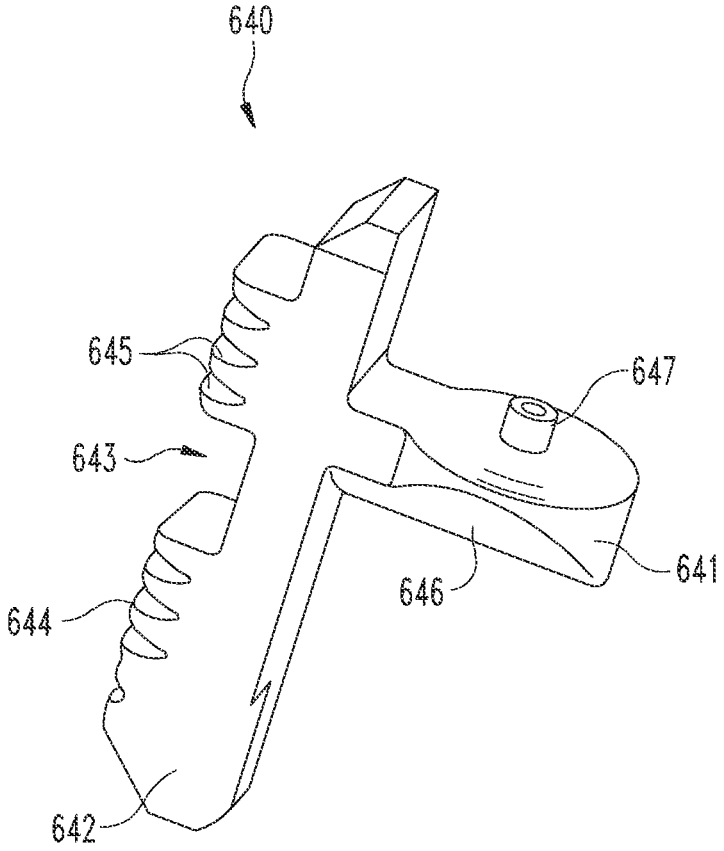
FIG. 6 is a perspective illustration of a rack pin according to an embodiment of the invention.

FIG. 6 depicts an alternative form of rack pin 640 which may be utilized in certain embodiments of the invention. The rack pin 640 is substantially similar to the previously-described rack pins 240, and similar reference characters are used to denote similar features. In the interest of conciseness, the following description focuses primarily on features which are different than those previously described with reference to the rack pins 240.

In the present form of the rack pin 640, the second leg 642 includes upper and lower portions extending from the first leg 641 in opposite directions, defining the rack pin 640 as a T-shaped rack pin. The upper and lower portions may engage the walls of the rack pin cavities 214, substantially constraining motion of the rack pin 640 to an axis parallel to the second leg 642 during key insertion.

The second leg 642 also includes a plurality of false gate notches 645 formed in the contact surface 644. If an unauthorized person attempts to pick the lock using the above-described method, the torque provided by the picker urges the sidebar 230 radially inward, and the protrusion 233 comes into contact with the contact surface 644. When the picker adjusts the position of the rack pin 640 with a picking tool, the sidebar protrusion 233 engages one of the false gate notches 645, changing the resistive force provided by the rack pin 640. The picker will falsely interpret this change in resistive force as indication that the rack pin 640 is in an unlocking position. Because the rack pin 640 is actually in the locking position, however, the engagement of the sidebar protrusion 233 and the contact surface 644 prevents rotation of the plug 200, as described above.

The first leg 641 also includes features which differ from the depictions of the first leg 241. For example, the first leg 641 includes a tapered portion 646 configured to facilitate travel of the rack pin 640 along the top cut of the key during key insertion. The tapered portion 646 may have a shape corresponding to the bitting length and tooth angle which are standard for a particular form of key. In such cases, the tapered portion 646 may be flush with adjacent teeth when the key is fully inserted, such that the rack pin 640 substantially prevents movement of the key in either direction when the plug 200 is in the rotated position. The first leg 641 may also include a protrusion 647 configured to be received in one end of a spring 204, to prevent the spring 204 from sliding out of engagement with the first leg 641 during operation.

While the figures depict only the L-shaped rack pin 240 and the T-shaped rack pin 640, other forms of rack pin are contemplated. In certain embodiments, one or more of the rack pins may include a third leg (not illustrated) on the opposite side of the first leg from the second leg. In such embodiments, the second and third leg may each extend in only one direction (U-shaped), may both extend in opposing directions (H-shaped), or one of the vertical legs may extend in both directions and the other may extend in only one direction (h-shaped). In such embodiments, the third leg may include sidebar-receiving notches, and the plug 200 may include a second sidebar similar to the sidebar 230, which prevents rotation of the plug 200 when the protrusion of the second sidebar is not aligned with the notches in the third leg.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus comprising:

a plug assembly, the plug assembly including:

a substantially cylindrical plug body defining a longitudinal first axis, a transverse second axis, a lateral third axis, and a central plane including the longitudinal first axis and the transverse second axis, the plug body comprising:

a keyway extending along the central plane of the plug body, wherein the keyway is structured to receive a key having a top cut;

a plurality of openings connected to the keyway, wherein each opening is defined in part by a ledge; and an axial channel formed on the outer surface of the plug body, and connected to the openings;

a sidebar positioned in the axial channel, the sidebar comprising an interference member formed on a radially inner side of the sidebar, and a tapered portion formed on a radially outer side of the sidebar, wherein the sidebar is biased in a radially outward direction;

a plurality of rack pins positioned in the openings, each of the rack pins defining a single-piece unitary structure including a laterally-extending first section positioned at least partially within the keyway, extending laterally across the central plane, and structured to engage the top cut of the key, and a transversely-extending second section extending from the first section in a first transverse direction and having a contact surface facing the axial channel, wherein each contact surface includes a receiving notch having a first lateral depth, wherein each receiving notch is configured to receive a portion of the interference member, wherein each of the rack pins is operable in a first transverse position in which the receiving notch is aligned with the interference member and a second transverse position in which the receiving notch is not aligned with the interference member; wherein each contact surface further comprises a false gate notch having a second lateral depth less than the first lateral depth; and wherein each rack pin extends laterally across the central plane on a single transverse side of the keyway; and a plurality of biasing members, wherein each of the biasing members is positioned in one of the openings and urges a corresponding one of the rack pins in the first transverse direction, and wherein the biasing members urge the first sections into contact with the ledges.

2. An apparatus according to claim 1, further comprising a cover plate rotatably coupled to the plug body, and operable to selectably expose and cover at least a portion of each opening while remaining coupled to the plug body; wherein the cover plate includes an arcuate segment; and wherein the cover plate is rotatable between an open position in which the openings are exposed, and a closed position in which the openings are covered by the arcuate segment of the cover plate.

3. An apparatus according to claim 2, the plug body further comprising a ridge configured to resist movement of the cover plate from the closed position.

4. An apparatus according to claim 3, the arcuate segment of the cover plate comprising a central angle between 180° and 220°, inclusive.

5. An apparatus according to claim 4, the arcuate segment of the cover plate including a channel configured to receive the ridge when the cover plate is in the open position.

6. An apparatus according to claim 2, wherein the cover plate further comprises a ring which circumferentially surrounds a portion of the plug body, and the arcuate segment comprising a central angle between 15° and 90°, inclusive.

7. An apparatus according to claim 1, wherein the second section of at least one of the rack pins further includes a second receiving notch configured to receive the portion of the interference member.

8. An apparatus according to claim 1, further comprising a shell including a chamber and an axial groove, wherein the plug assembly is positioned at least partially within the chamber and the tapered portion is positioned at least partially within the axial groove.

9. An apparatus according to claim 8, wherein the plug assembly is rotatable with respect to the shell in an unlocked state in which the receiving notch of each rack pin is aligned with the interference member, and is not rotatable with respect to the shell in a locked state in which the receiving notch of at least one of the rack pins is not aligned with the interference member.

10. The apparatus of claim 1, wherein the first section is arranged perpendicular to the second section.

11. An apparatus comprising:

a plug defining a longitudinal first axis, a transverse second axis, a lateral third axis, and a central plane including the longitudinal first axis and the transverse second axis, the plug including a keyway extending along the central plane, a plurality of cavities in communication with the keyway, and an axial channel in communication with the plurality of cavities, wherein the keyway is structured to receive a key having a top cut;

a plurality of rack pins, wherein each of the rack pins is positioned in one of the cavities, wherein each of the rack pins comprises a single-piece unitary construction including a laterally-extending first leg and a transversely-extending second leg extending transversely from the first leg in a first transverse direction, wherein the first leg is positioned at least partially in the keyway, extends laterally across the central plane, and is structured to engage the top cut of the key, and the second leg includes a contact surface facing the axial channel, wherein each contact surface includes a receiving notch, and wherein each rack pin extends laterally across the central plane on a single transverse side of the keyway;

a sidebar seated in the axial channel, wherein a radially outer side of the sidebar facing away from the central plane includes a tapered portion, and a radially inner side of the sidebar facing toward the central plane includes an interference member sized and configured to be received in the receiving notch of each rack pin, and wherein the sidebar is biased in a radially outward direction toward an outer position in which the tapered portion protrudes beyond an outer surface of the plug; and a plurality of biasing members, wherein each of the biasing members is positioned in one of the cavities and urges a corresponding one of the rack pins in the first transverse direction;

wherein the sidebar is free to move radially inward toward an inner position when the interference member is aligned with the receiving notch of each rack pin, and is not free to move radially inward when the interference member is not aligned with the receiving notch of at least one of the rack pins; and wherein each cavity is defined in part by a ledge, and wherein the biasing members urge the first legs into contact with the ledges.

12. The apparatus of claim 11, wherein each contact surface further includes a plurality of false gate notches.

13. The apparatus of claim 11, wherein each of the rack pins is wholly contained within the plug.

14. The apparatus of claim 13, wherein only the sidebar protrudes beyond the outer surface of the plug.

15. The apparatus of claim 11, further comprising:

a shell including a chamber and an axial groove, wherein the chamber is generally cylindrical and is defined by an inner surface of the shell;

wherein the plug is rotatably mounted in the chamber, and a shear line is formed between the outer surface of the plug and the inner surface of the shell; and wherein, with the sidebar in the outer position, the sidebar crosses the shear line and the tapered portion is received in the axial groove.

16. The apparatus of claim 15, wherein each of the rack pins is wholly contained within the plug and only the sidebar is operable to cross the shear line.

17. The apparatus of claim 15, wherein the shell is towerless.

18. The apparatus of claim 11, further comprising a cover plate coupled to the plug, the cover plate retaining the rack pins within the cavities.

19. The apparatus of claim 18, wherein the cover plate is movably coupled to the plug and has a closed position in which rack pins are retained within the cavities and an open position in which the rack pins are removable from the cavities.

20. The apparatus of claim 19, wherein the open position is a first angular position, wherein the closed position is a second angular position, and wherein the cover plate is rotatable between the first and second angular positions.

21. The apparatus of claim 20, wherein the plug includes a radial protrusion configured to resist rotation of the cover plate when the cover plate is in the first angular position.

22. The apparatus of claim 21, wherein the cover plate includes a hole configured to receive the radial protrusion when the cover plate is in the first angular position, and wherein the radial protrusion resists rotation of the cover plate when the cover plate is in the first angular position.

23. The apparatus of claim 11, wherein each laterally-extending first leg extends laterally across the central plane from a first lateral side of the keyway to an opposite second lateral side of the keyway.

* * * * *